United States Patent [19]

Huzyak

[11] 4,194,383

[45] Mar. 25, 1980

[54] MODULAR TRANSDUCER ASSEMBLY FOR ROLLING MILL ROLL ADJUSTMENT MECHANISM

[75] Inventor: Paul Huzyak, Salem, Ohio

[73] Assignee: Gulf & Western Manufacturing Company, Southfield, Mich.

[21] Appl. No.: 917,964

[22] Filed: Jun. 22, 1978

[51] Int. Cl.[2] ..... B21B 37/08

[52] U.S. Cl. ..... 72/245; 72/21; 92/5 R; 324/207; 33/DIG. 15

[58] Field of Search ..... 72/6–8, 72/245, 21, 19; 92/5; 91/1, 363 R, 363 A; 33/DIG. 15

[56] References Cited

U.S. PATENT DOCUMENTS

| | | | |
|---|---|---|---|
| Re. 28,248 | 11/1974 | Herbst | 72/8 |
| 3,128,630 | 4/1964 | Briggs | 73/432 |
| 3,208,251 | 9/1965 | Hulls et al. | 72/11 |
| 3,353,385 | 11/1967 | Neumann et al. | 72/21 |
| 3,427,839 | 2/1969 | Neumann | 72/20 |
| 3,757,553 | 9/1973 | Greenberger | 72/21 |
| 3,839,944 | 10/1974 | Swift | 92/5 R |
| 3,861,183 | 1/1975 | Fukui | 72/21 |
| 3,928,994 | 12/1975 | Ichiryu et al. | 72/8 |

*Primary Examiner*—Milton S. Mehr
*Attorney, Agent, or Firm*—Meyer, Tilberry & Body

[57] ABSTRACT

A modular linear transducer assembly is mounted between relatively displaceable piston and cylinder members of a hydraulic roll gap control arrangement in a four-high rolling mill stand. The piston and cylinder members have coaxial openings centrally therethrough which receive the modular transducer assembly. The transducer assembly includes axially displaceable sleeve and plunger members, one of which is attached to the piston member and the other to the cylinder member for displacement therewith. The plunger supports a low voltage differential transformer coil having an axial passageway therethrough, and the sleeve member supports a core rod which extends into the coil passageway. Relative displacement between the piston and cylinder members imparts corresponding relative displacement between the coil and core rod to produce a signal indicative of roll gap change. The positions of the coil and core rod relative to one another are adapted to be adjusted at opposite ends of the modular transducer assembly without removing the assembly from the piston and cylinder members, and the transducer assembly is adapted to be installed and removed as a unit with respect to the piston and cylinder members.

23 Claims, 6 Drawing Figures

MODULAR TRANSDUCER ASSEMBLY FOR ROLLING MILL ROLL ADJUSTMENT MECHANISM

BACKGROUND OF THE INVENTION

This invention relates to the art of rolling mills and, more particularly, to a modular transducer assembly for use in a rolling mill roll gap controlling system.

The transducer assembly of the present invention finds particular utility in conjunction with a hydraulic gauge control system for a four-high mill and which system includes relatively displaceable hydraulic piston and cylinder members through which force is applied to the upper back-up roll. Accordingly, the invention will be described with particular reference to such a mill and gauge control system; however, it will be appreciated that the invention can be utilized in other types of mills and in conjunction with relatively displaceable members of a roll gap controlling system other than force applying piston and cylinder members.

Generally, a four-high rolling mill utilizes large diameter screw-down roll positioning screws associated with the upper back-up roll chocks at the opposite ends of the upper back-up roll. The upper back-up roll chocks as well as the upper work roll chocks of the mill are vertically slidably supported in windows of the mill frame. The screw-down screws operate to position the upper back-up roll and thus the upper work roll relative to the lower work roll and lower back-up roll in accordance with the desired gauge for the material passing between the work rolls. Generally, a gauge control system is employed to determine relative displacement between the work rolls indicative of a variance from the desired gauge and to actuate appropriate roll adjusting mechanisms for adjusting the upper back-up roll and thus the upper work roll in accordance with such variances. In certain roll mill arrangements, the screw-down screws operate basically to position the upper back-up roll and thus the upper work roll relative to the lower work roll and lower back-up roll, and roll force is applied to the upper back-up roll by means of a hydraulic cylinder and piston unit interposed between each of the screw-down screws and the chock for the corresponding end of the upper back-up roll. In an arrangement of this character, hydraulic fluid under pressure is interposed between the piston and cylinder members, one of which bears against the lower end of the screw-down screw and the other of which bears against the top surface of the back-up roll chock, thus to apply the roll force necessary to roll material to the desired gauge. A variance in the gauge of the material passing between the work rolls of the mill causes relative displacement between the piston and cylinder members, and such relative displacement is employed to produce a control signal by which necessary adjustments can be made to maintain a desired predetermined roll gap between the work rolls. More particularly, a transducer assembly is employed between the piston and cylinder members to provide an output signal indicative of roll gap variations.

In conjunction with such a rolling mill having a hydraulic roll force applying arrangement, the piston and cylinder members are generally supported for removal from the roll mill frame for maintenance and for other purposes including maintenance or replacement of the transducer assembly mounted therebetween. Heretofore, transducer assemblies provided for use with hydraulic force applying arrangements have been linear transducer assemblies including relatively displaceable transducer components mountable in aligned openings in the piston and cylinder members. Such a transducer assembly includes a transformer coil and a core rod as the relatively displaceable transducer components and, heretofore, each of these components has been a structurally separate component assembled with respect to the other during sequential mounting thereof on the piston and cylinder members. In order to obtain optimum sensitivity with respect to response to variations in roll gap, the core rod component is in an extremely small diameter rod of piano wire dimension in cross section and, accordingly, is often bent during the assembly procedure when attempting to introduce the wire into the coil opening. Accordingly, the assembly procedure is not only tedious and time consuming, but often results in having to replace the component part carrying the core rod, thus further increasing assembly time and the assembly cost as a result of such part replacement. Still further, the relatively displaceable transducer components have a null or reference signal position relative to one another and previous transducer arrangements have required considerable time and effort to accomplish null positioning. In this respect, only one of the transducer components of such previous transducers is adjustable relative to the other, and the adjustment is only possible from the end of the piston and cylinder assembly facing the back-up roll chock. Therefore, when the hydraulic roll force applying assembly is removed from the roll mill frame and supported on a bench or the shop floor, the adjustable end of the assembly is not exposed. Accordingly, it is necessary to elevate or otherwise suitably support the roll force applying assembly to gain access to the underside thereof for null adjustment. If null adjustment is all that is required in connection with a maintenance procedure, such a special effort to achieve the adjustment is undesirably time consuming. Another disadvantage of such previous transducer arrangements resides in the fact that the structurally separate character thereof exposes the transformer coil and core rod to the adverse effects of the surrounding environment prior to assembly thereof on the piston and cylinder members and during any subsequent removal thereof from the piston and cylinder members.

SUMMARY OF THE INVENTION

In accordance with the present invention, a linear transducer assembly is provided which overcomes or avoids the disadvantages of previous transducer assemblies including those enumerated above. More particularly, the transducer assembly according to the present invention is a modular unit of preassembled component parts in which the transducer components are completely enclosed at all times and thus protected from the surrounding environment prior to assembly thereof between the piston and cylinder members and following removal thereof from the piston and cylinder members. Moreover, the modular construction advantageously enables assembly or disassembly of the unit with respect to the piston and cylinder members in less time than heretofore required and without subjecting the transducer components to possible damage by physical interengagement therebetween which can result from separating or joining the transducer components themselves. The modular construction further assures maintaining sensitivity of the transducer both by avoiding damage of the transducer components during assembly and by complete enclosure of the transducer components and the consequent protection from exposure to the surrounding environment. Still further, in connection with another aspect of the present invention, both ends of the transducer assembly are provided with arrangements for adjusting the null position of the transducer components, and the modular transducer assembly is mountable in a through opening between the piston and cylinder members of the roll force applying assembly, whereby at least one end of the transducer assembly is exposed when the roll force applying assembly is removed from the roll mill frame. Accordingly, null adjustment can advantageously be achieved when the force applying assembly is supported on a work bench or the shop floor in a manner whereby the underside of the assembly is not readily accessible.

Preferably, the modular transducer unit includes an expandable and retractable housing comprised of sleeve and plunger members providing an interior chamber in which the transducer components are disposed. One of the transducer components is mounted on the sleeve and the other on the plunger, whereby they are relatively displaceable in response to relative displacement of the sleeve and plunger. The sleeve and plunger members are adapted to be fastened one to the piston and the other to the cylinder of the roll force applying assembly in a through opening therein. The plunger mounting arrangement provides for the axial position of the plunger and thus the transducer component supported thereon to be adjusted relative to the sleeve from one end of the transducer assembly. The opposite end of the transducer assembly is defined by an end wall on the sleeve member, and the other transducer component is supported relative to the end wall for adjustment axially of the sleeve and thus axially of the transducer component supported by the plunger.

It is accordingly an outstanding object of the present invention to provide an improved transducer assembly for mounting between relatively displaceable members of a roll mill roll gap adjusting mechanism.

Another object is the provision of a modular transducer assembly for the foregoing purpose and in which the transducer components are enclosed in an expandable and contractable housing.

A further object is the provision of a transducer assembly of the foregoing character having opposite ends and in which the transducer components are adjustable relative to one another from each of the opposite ends of the assembly.

Still a further object is the provision of a transducer assembly of the foregoing character comprised of preassembled transducer components including a transformer coil and core rod enclosed within a chamber defined by relatively displaceable sleeve and plunger members each supporting one of the coil and core rod components.

Yet another object is the provision of a transducer assembly of the foregoing character which is mountable in a through opening in piston and cylinder members of a hydraulic roll force applying assembly.

Still a further object is the provision of a transducer assembly of the foregoing character in which the opposite ends of the transducer assembly are exposed at opposite ends of the through opening in the piston and cylinder members of the roll force applying assembly and in which the transducer components are independently adjustable relative to one another, one from each end of the transducer assembly.

Yet another object is the provision of a modular transducer assembly of the foregoing character which is structurally simple and readily mountable on and removable from the piston and cylinder members of a hydraulic roll force applying assembly and which, when so mounted, readily facilitates null adjustment of the transducer components from opposite sides of the force applying assembly.

BRIEF DESCRIPTION OF THE DRAWINGS

The foregoing objects, and others, will in part be obvious and in part pointed out more fully hereinafter in conjunction with the written description of the accompanying drawings showing a preferred embodiment of the invention and in which.

DESCRIPTION OF A PREFERRED EMBODIMENT

Figure 1:
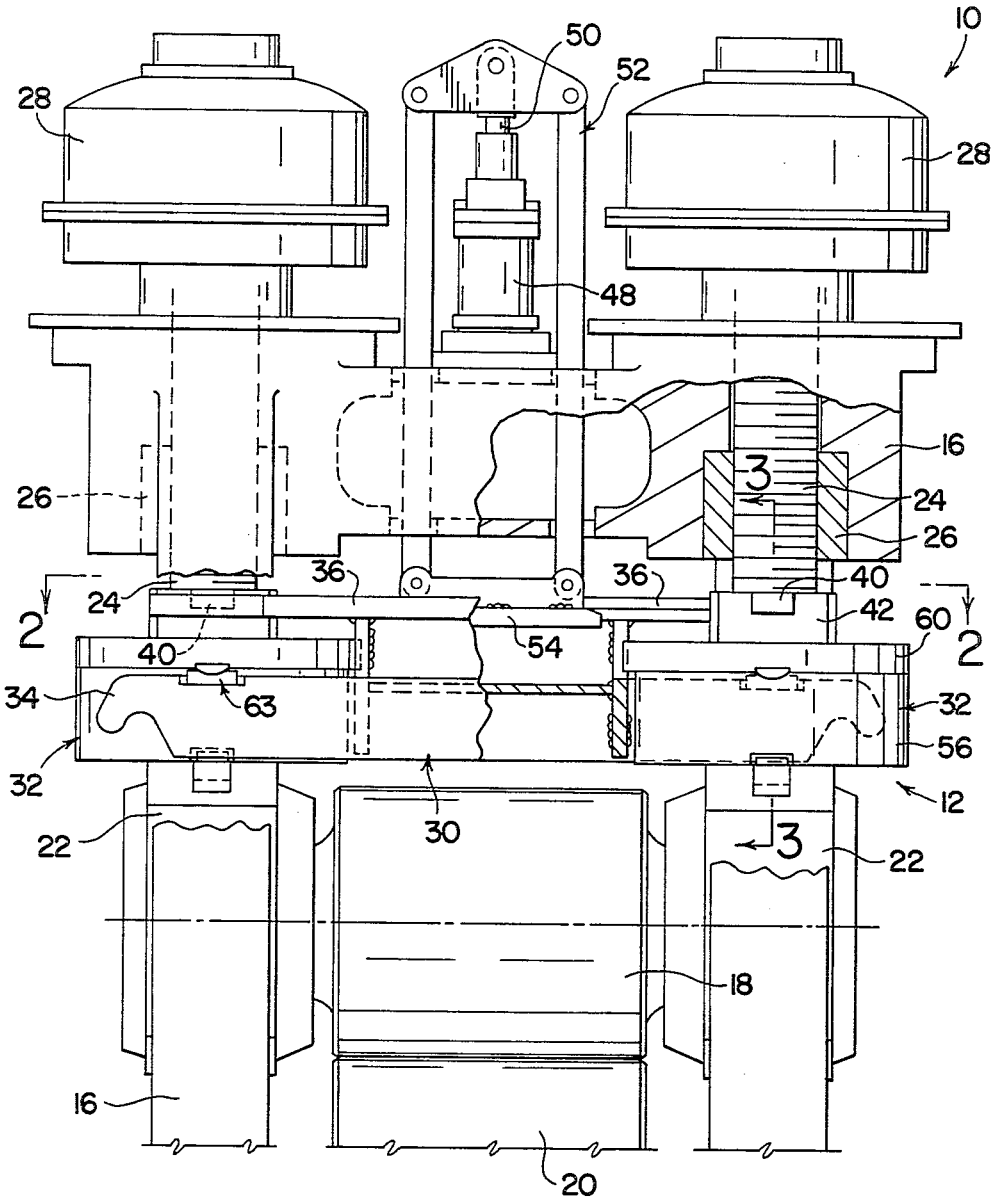
FIG. 1 is an elevation view, partially in section, of the upper portion of a four-high mill stand.
Figure 2:
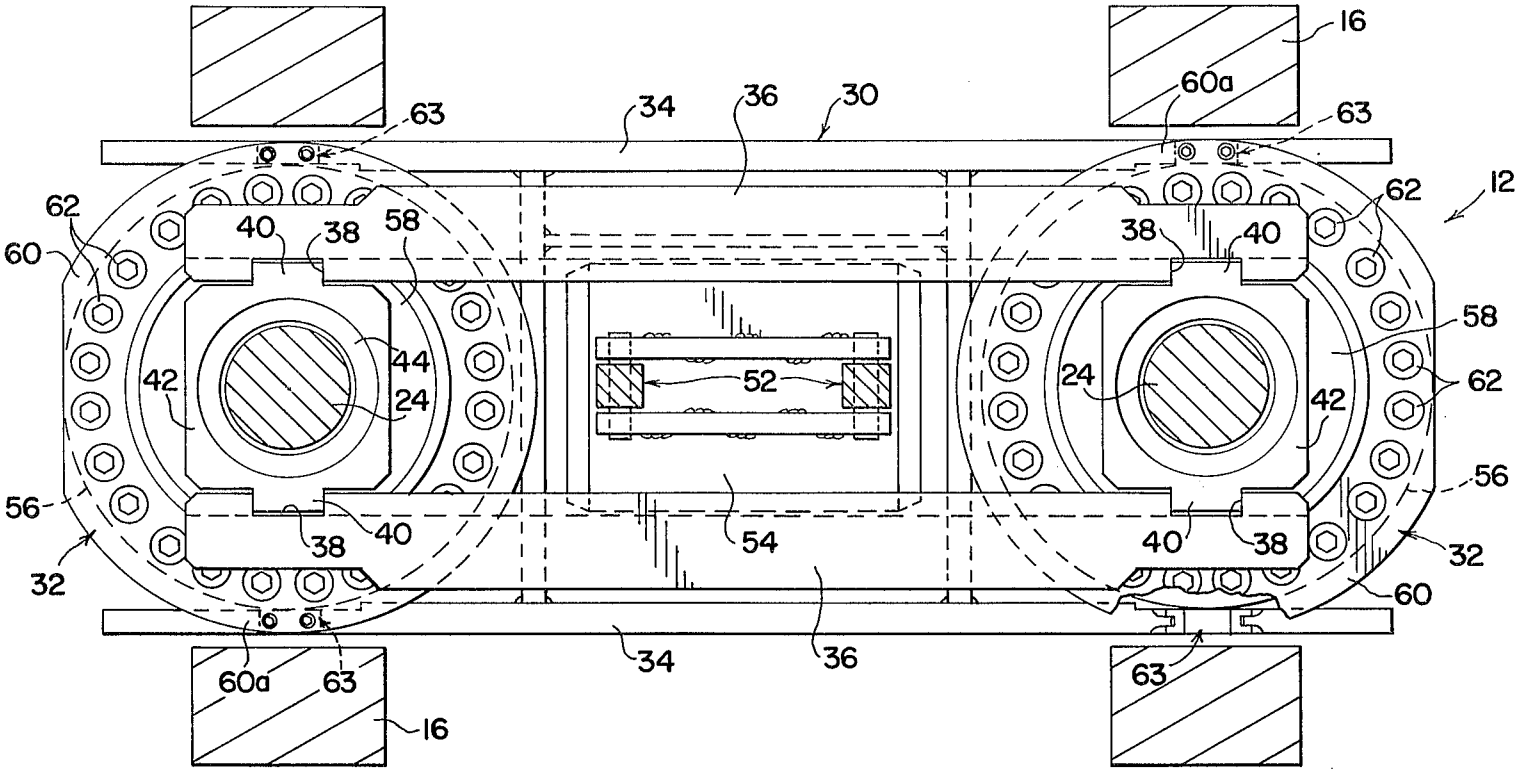
FIG. 2 is a sectional plan view taken along line 2—2 in FIG. 1.
Figure 3:
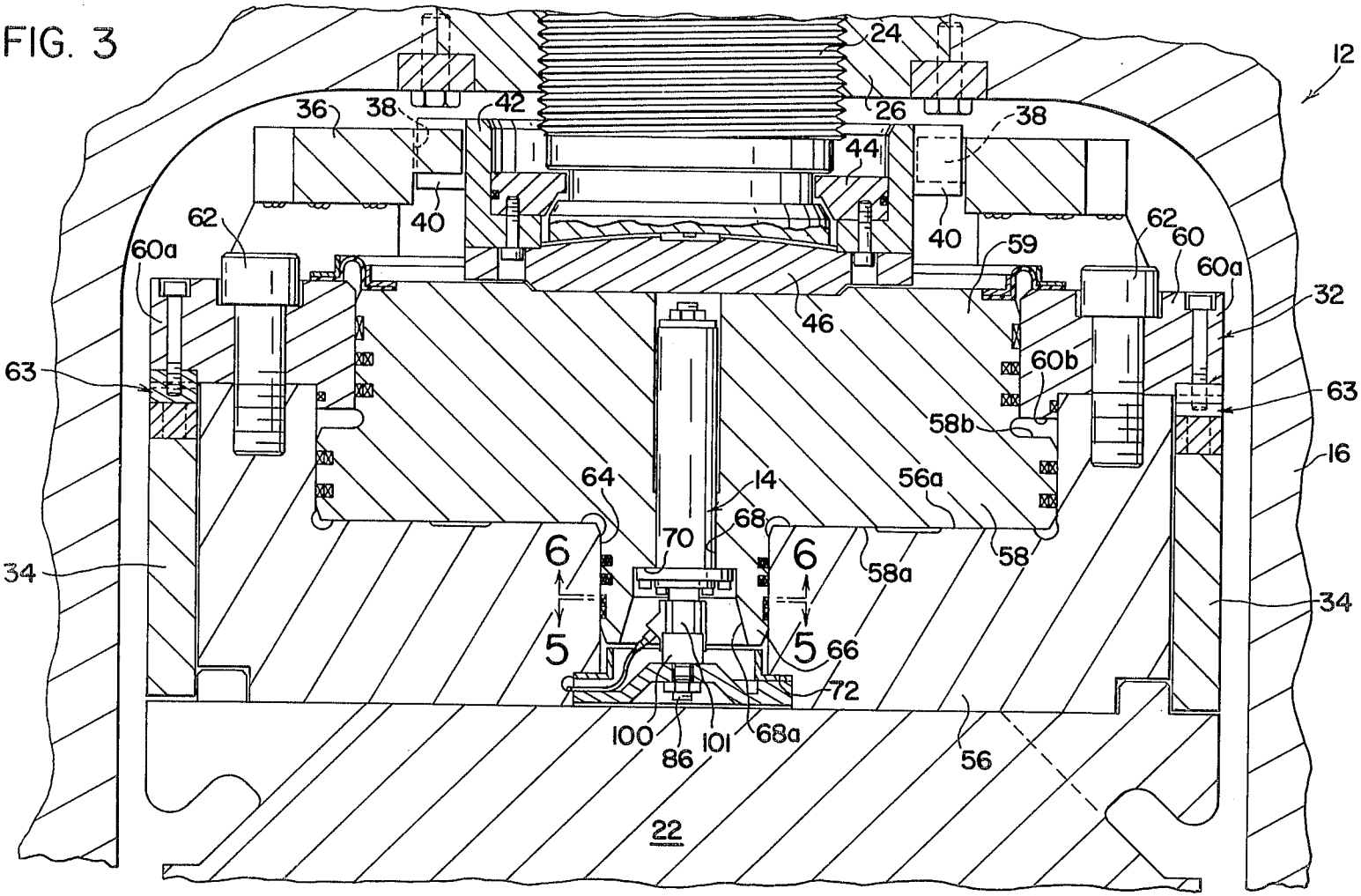
FIG. 3 is a sectional elevation view taken along line 3—3 in FIG. 1.

Referring now in greater detail to the drawings wherein the showings are for the purpose of illustrating a preferred embodiment of the invention only and not for the purpose of limiting the invention, FIGS. 1, 2 and 3 illustrate components of the upper portion of a four-high mill stand 10 including a hydraulic roll force applying assembly 12 removably supported in the mill frame and carrying modular transducer assemblies 14 of the present invention. As is conventional, mill stand 10 includes a main frame or mill housing 16 which carries an upper or top back-up roll 18 and an upper or top work roll 20. It will be understood of course that a lower work roll and a lower back-up roll are positioned beneath rolls 18 and 20. The necks of back-up roll 18 are rotatably mounted in suitable bearing chocks 22 arranged for vertical sliding movement in windows at opposite ends of mill frame 16, and the working force for the mill rolls is applied by means of screw-down screws 24 supported by the mill frame at the opposite ends of the upper back-up roll and corresponding hydraulic force applying piston and cylinder units of force applying assembly 12, as described more fully hereinafter. Screw-down screws 24 are threadedly interengaged with corresponding nuts 26 fixedly mounted in frame 16 and are driven in a conventional manner by reversible worm screw drive units 28 carried on the top of the mill frame.

Hydraulic force applying assembly 12 is comprised of a frame assembly 30 extending longitudinally of the upper back-up roll and carrying roll force applying piston and cylinder assemblies 32 at the opposite ends thereof and each of which is vertically aligned with the corresponding ones of the screw-down screws 24 and upper back-up roll chocks 22. More particularly, frame assembly 30 includes longitudinally extending side members 34 on which the piston and cylinder assemblies 32 rest, and longitudinally extending top members 36. Frame members 36 are laterally spaced apart from one another, vertically spaced from the corresponding side member 34, and suitably rigidly interconnected with the side members. The opposite ends of frame members 36 are provided with laterally inwardly facing opposed recesses 38 slidably receiving corresponding projections 40 on a housing member 42 rotatably mounted on the lower end of each screw-down screw 24 by means of a retaining ring 44. Recesses 38 and projections 44 interengage to restrain rotation of housings 42 in response to rotation of screws 24, and the housings interengage frame members 36 to properly position the hydraulic piston and cylinder assemblies 32 relative to the corresponding screw-down screw 24 and back-up roll chock 22. The lower end of each screw-down screw 24 rotatably engages a spherical bearing insert 46 interposed between the screw-down screw and hydraulic piston and cylinder assembly 32.

Mill frame 16 is provided between screw-down screws 24 with a hydraulic piston and cylinder unit including a cylinder 48 suitably mounted on the mill frame and a piston rod 50 vertically reciprocable relative to the cylinder. Piston rod 50 is connected through a linkage assembly 52 with a horizontal support plate 54 which slidably engages the underside of upper frame members 36 of the hydraulic force applying assembly 12. Extension of piston rod 50 relative to cylinder 48 displaces plate 54 and thus frame assembly 30 and piston and cylinder assemblies 32 up relative to screw-down screws 24, and retraction of the piston rod enables displacement of the frame assembly and piston and cylinder assemblies downwardly relative to screw-down screws 24. Accordingly, it will be appreciated that screw-down screws 24 can be retracted upwardly relative to mill frame 16 permitting elevation of hydraulic force applying assembly 12 and upper back-up roll 18 by extension of piston rod 50 relative to cylinder 48. Upper back-up roll 18 can then be removed from the mill frame after which piston rod 50 can be retracted relative to cylinder 48 to lower hydraulic force applying assembly 12 relative to screw-down screws 24. Thereafter, hydraulic force applying assembly 12 can be removed by sliding the unit outwardly of the frame relative to support plate 54.

As best seen in FIG. 3 of the drawing, each piston and cylinder assembly 32 of the hydraulic force applying assembly 12 includes a cylinder 56 and a piston 58 slidably received therein. A retaining ring 60 is attached to the upper end of cylinder 56 by means of bolts 62 and sealingly engages the upper end 59 of piston 58. Diametrically opposed radially outer portions 69*a* of retaining ring 60 overlie side members 34 of frame assembly 30, and each piston and cylinder assembly 32 is supported in suspension between frame members 34 by rocker and shoe assemblies 63 between retaining ring portion 60*a* and frame members 34, as seen in FIG. 1. In the embodiment shown, piston 58 is a double acting piston and cylinder 56 is provided with fluid passageways, not shown, for delivering hydraulic fluid under pressure from a suitable source to opposite sides of the piston. It will be appreciated that such opposite sides of the piston are defined by bottom surface 58*a* thereof which faces cylinder surface 56*a* and by surface 58*b* of the piston which faces surface 60*b* of retainer ring 60. For purposes of the present invention, it is only necessary to understand that hydraulic fluid under pressure is introduced between the piston and cylinder members to control the positions thereof relative to one another, that the bottom of cylinder 56 rests directly against the top surface of back-up roll chock 22 and that the upper surface of piston 58 engages the lower end of screw-down screw 24 through insert pad 46. Accordingly, when the hydraulic force applying assembly 12 is in place in the mill stand it will be appreciated that relative displacement of the piston and cylinder members 56 and 58 applies a downward force on upper back-up roll chocks 22 to apply the necessary roll force for operation of the rolling mill. The hydraulic system by which this is achieved is not important to the present invention, and it is well known that the hydraulic system operates to vary the hydraulic pressure and thus the roll force in order to maintain a desired roll gap between the work rolls. It will be further appreciated from the above description that a variation in the gap between the work rolls causes displacement of upper back-up roll chock 22 relative to the mill frame and accordingly relative displacement between cylinder 56 and piston 58. As will become apparent hereinafter, such relative displacement between cylinder 56 and piston 58 is detected by transducer assembly 14 which operates to produce an output signal indicative of such relative displacement. Such signal can, for example, be employed through appropriate controls in the hydraulic system to vary the hydraulic pressure so as to maintain the desired work roll gap.

The structure and operation of transducer assembly 14 of the present invention will be best understood with reference to FIGS. 3–6 of the drawing. As shown in FIG. 3, cylinder member 56 is provided with an opening 64 extending through the end wall of the cylinder, and piston 58 includes a lower extension 66 slidably received in opening 64. Further, piston 58 is provided with a cylindrical passageway 68 extending axially therethrough from the upper end of the piston and which passageway includes a radially enlarged portion 68*a* in piston extension 66. Passageway portion 68*a* provides a radial shoulder 70 spaced axially inwardly of the lower end of extension 66, and the bottom surface of cylinder 56 is provided with an axially extending cylindrical recess providing a shoulder 72.

Figure 4:
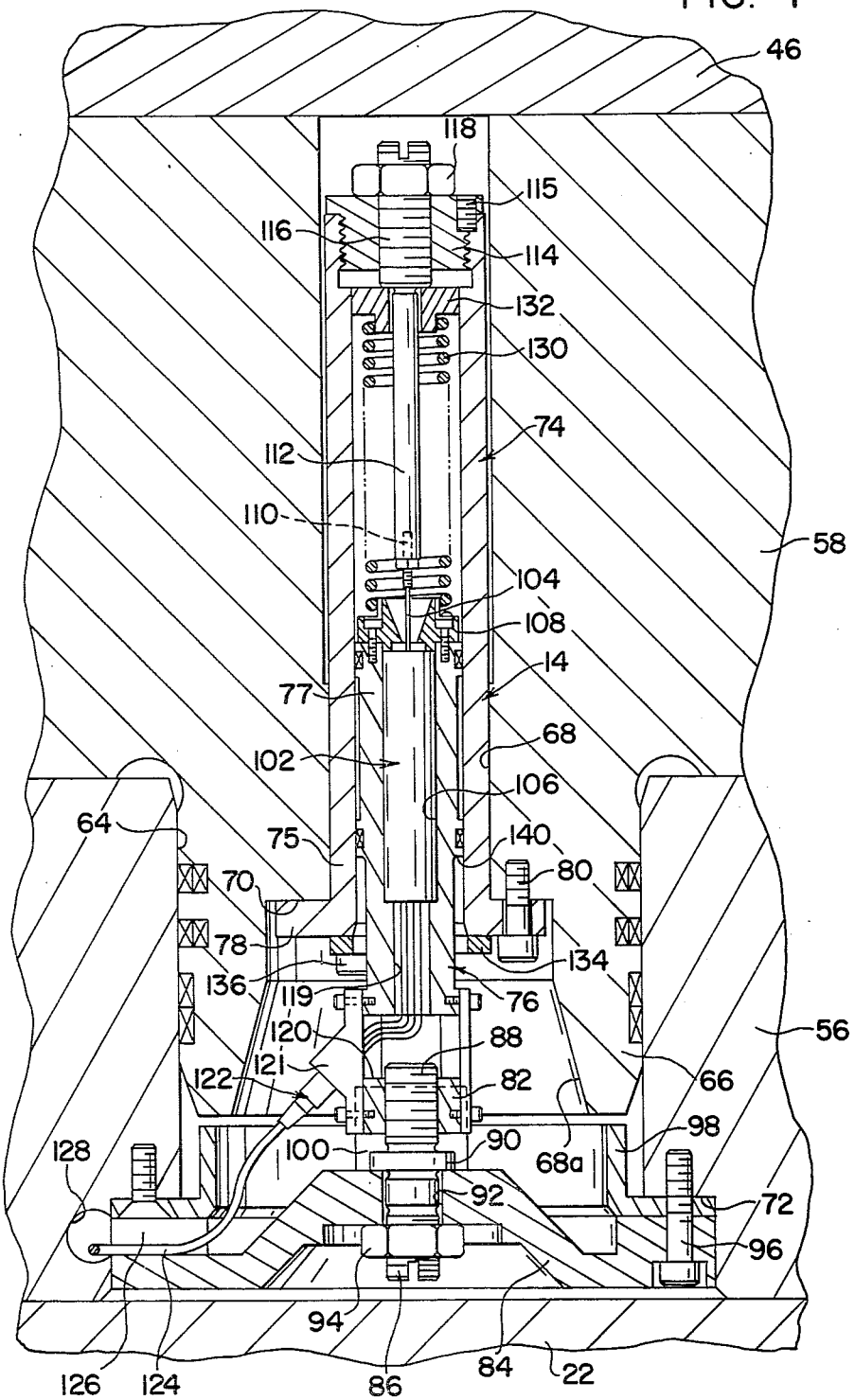
FIG. 4 is a detail sectional elevation view of the modular transducer shown in FIG. 3.
Figure 5:
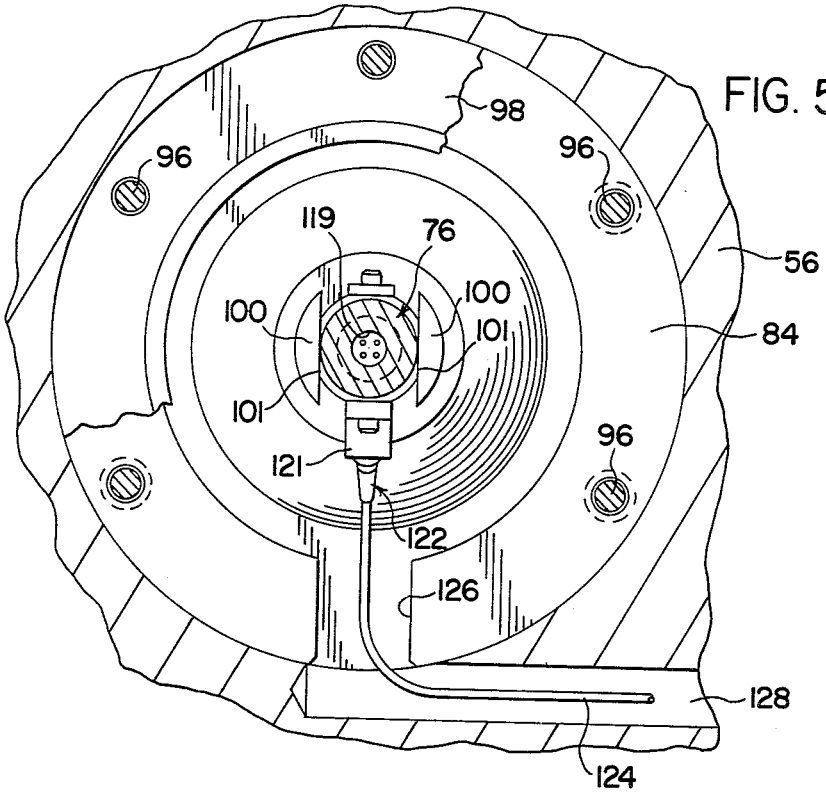
FIG. 5 is a detail sectional view of the transducer taken along line 5—5 in FIG. 3; and, FIG. 6 is a detail sectional view of the transducer taken along line 6—6 in FIG. 3.
Figure 6:
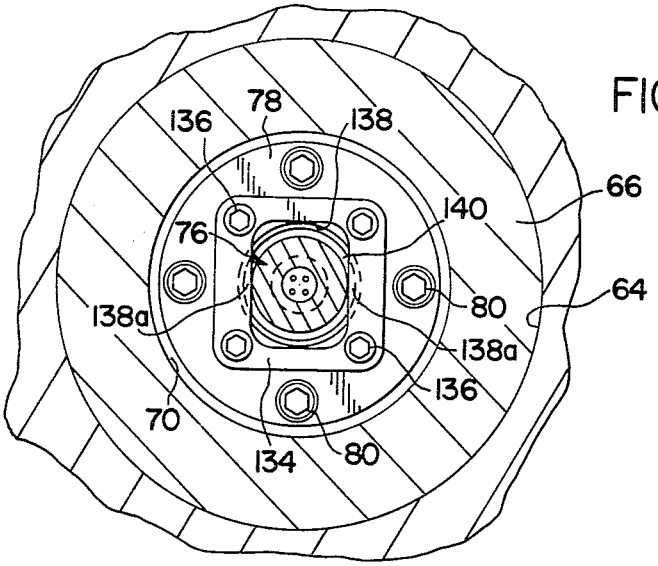

As shown generally in FIG. 3 and in detail in FIGS. 4–6, transducer assembly 14 is received in openings 64 and 68 in the cylinder and piston members and has opposite ends respectively adjacent the top surface of piston 58 and the bottom surface of cylinder 56. The transducer assembly includes an extendable and retractable housing enclosing the transducer components and supporting the latter components for displacement relative to one another to produce an output signal. In the preferred embodiment shown, the housing includes a sleeve 74 having an open inner end 75, and a plunger 76 having an inner end 77 axially slidably received in the inner end of sleeve 74. Sleeve 74 is received in opening 68 of piston member 58 from the lower end of the opening and is removably attached to piston 58 and against shoulder 70 by means of a radially outwardly extending mounting flange 78 on the sleeve and a plurality of bolts 80. Accordingly, sleeve 74 is displaceable with piston 58.

The outer end 82 of plunger 76 is adapted to be interconnected with cylinder 56 of the hydraulic force applying assembly for displacement therewith and, accordingly, for displacement relative to transducer housing sleeve 74. In the preferred embodiment shown, the interconnection between plunger 76 and cylinder 56 is achieved by means of an annular retaining plate 84 which is removably attached to cylinder 56, and an adjusting stud 86 interconnecting outer end 82 of plunger 76 with retaining plate 84. Adjusting stud 86 has an inner end 88 threadedly interengaged with a threaded opening in outer end 82 of plunger 76, and is provided with a radially extending flange 90 engaging the inner side of retaining plate 84. The outer end of adjusting stud 86 extends loosely through an opening 92 in retaining plate 84 and is externally threaded to receive a jam nut 94. Stud 86 is rotatable relative to plate 84 and plunger 76, and jam nut 94 provides for the adjusting stud to be selectively released to permit such rotation or tightly engaged with the retaining plate to prevent such rotation. Retaining plate 84 extends radially of plunger 76 and is releasably attached to cylinder 56 of the hydraulic force applying assembly by means of a plurality of bolts 96. Preferably, an annular L-shaped member 98 is interposed between the periphery of retaining plate 84 and shoulder 72 of cylinder 56 to provide an annular area for receiving any hydraulic fluid which may leak past cylinder 56 and piston extension 66.

It will be appreciated that the retaining plate and adjusting stud arrangement provides for plunger 76 to be displaceable with cylinder 56 of the hydraulic force applying assembly and thus relative to transducer housing sleeve 74. It will be further appreciated that when jam nut 94 is loosened to permit rotation of adjusting stud 86 in opposite directions relative to retaining plate 84, such rotation of stud 86 imparts axial displacement to plunger 76 by means of the threaded interengagement between end 88 of the stud and outer end 82 of the plunger. Such axial displacement of plunger 76 is relative to retaining plate 84 and to sleeve 74. As best seen in FIG. 5, retaining plate 84 is provided with opposed axially extending fingers 100 having flat inner faces engaging flats 101 provided on the outer end of plunger 76 to prevent rotation of plunger 76 in response to rotation of adjusting stud 86.

As mentioned above, the transducer housing completely encloses the transducer components and supports the latter components for displacement relative to one another to provide an output signal indicative of relative displacement between the piston and cylinder members of the hydraulic roll force applying assembly. In the embodiment shown, the transducer is a low voltage differential transformer assembly including a transformer coil 102 having an axially extending passageway therethrough, not shown, and a thin wire core rod 104 axially slidably received in the coil opening. Transformer coil 102 is received in an axially extending recess 106 in the inner end of plunger 76 and is axially retained therein by means of an annular retaining ring 108 bolted to the inner end of the plunger. Core rod 104 has an outer end 110 threadedly interengaged with or otherwise mounted on the inner end of an adjusting rod 112. The outer end of sleeve 74 of the transducer housing is provided with a removable end cap 114 which supports adjusting rod 112 and thus core rod 104 for axial displacement relative to sleeve 74. More particularly in this respect, outer end 116 of adjusting rod 112 is threadedly interengaged with an opening through end cap 114, whereby the adjusting rod is rotatable in opposite directions relative to the end cap, and a jam nut 118 is provided on the outer end of the adjusting rod enabling the latter to be releaseably locked against rotation relative to the end cap. Accordingly, it will be appreciated that jam nut 118 can be loosened to permit rotation of adjusting rod 112 relative to the end cap and that such rotation in opposite directions axially displaces the adjusting rod and thus core rod 104 relative to sleeve 74 and transformer coil 102. Preferably, end cap 114 is threadedly mounted on sleeve 74, and a threaded pin 115 is provided to prevent rotation of the end caps relative to the sleeve during rotation of adjusting rod 112.

Plunger 76 is provided with wiring passageways 119 and 120 leading from the bottom of recess 106 through the outer end of the plunger to a wiring fixture 121 mounted on the plunger. A releaseable coupling 122 enables disconnecting the transducer assembly from a supply cable 124. It will be appreciated that cable 124 is connected to appropriate circuitry for receiving an output signal from the transducer assembly, and retaining plate 84 and cylinder 56 are respectively provided with passageways 126 and 128 for bringing cable 124 to the transducer assembly from such circuitry.

A biasing spring 130 surrounds adjusting rod 112 and has an inner end abutting against retaining ring 108 on plunger 76 and has an outer end abutting against an annular spring seat 132 in housing sleeve 74. Spring seat 132 abuts against the inner end of threaded portion 116 of adjusting rod 112. When the transducer assembly is mounted between the piston and cylinder members of the hydraulic force applying assembly, spring 130 applies an axial force in the direction tending to extend the transducer housing. This spring force advantageously stabilizes the transformer coil and core rod by eliminating undesirable relative axial displacement which might otherwise take place therebetween during operation of the mill. For example, the force restrains displacement which would occur as a result of thread clearances between end 82 and the plunger and threaded end 88 of adjusting stud 86, and thread clearances which would exist between threaded portion 114 of adjusting rod 112 and the threaded opening in end cap 114 should jam nut 118 become loose. In order to retain the plunger and sleeve components in assembled relationship upon removal of the transducer assembly from the piston and cylinder members as set forth hereinafter, a retaining plate 134 is mounted on inner end 75 of sleeve 74 by means of a plurality of bolts 136. As best seen in FIGS. 4 and 6, retaining plate 134 is provided with an opening 138 having edge portions **138*a* adapted to engage a shoulder 140 on plunger 76 to limit displacement of the plunger outwardly of sleeve 74**.

It will be appreciated that the transformer coil and core rod components have an axial position relative to one another which is called a null or reference position, and that relative axial displacement between the transducer components from the null position produces an electrical signal indicative of the direction of such displacement. Accordingly, the signal is also indicative of the direction of relative displacement between the piston and cylinder members of the hydraulic force applying assembly. It will be appreciated from the foregoing description of the transducer assembly that adjustment of the transducer components to achieve null positioning therebetween can advantageously be made from either of the opposite ends of the assembly. In this respect, as described above, core rod 104 can be adjusted axially relative to housing sleeve 74 and thus axially relative to transformer coil 102 from the upper end of the transducer assembly adjacent the top side of piston 58. Further, as described above, plunger 76 and thus transformer coil 102 can be axially adjusted relative to housing sleeve 74 and thus relative to core rod 104 from the lower end of the transducer assembly adjacent the bottom of cylinder 56. Accordingly, it will be appreciated that the upper back-up roll of the mill can be removed and a null adjustment can be made with the hydraulic roll force applying assembly in place in the mill stand if, for example, it is otherwise unnecessary to remove the force applying assembly. On the other hand, should it be necessary for any reason to remove the roll force applying assembly from the mill stand, the latter assembly is placed on a bench or on the shop floor whereby the lower end of the transducer assembly is not readily accessible. In this case, null adjustment can be readily made from the upper end of the assembly.

Should it become necessary to remove the transducer assembly for repair or replacement purposes, such removal is easily and quickly achieved. In this respect, with reference to FIG. 4, jam nut 94 is removed from adjusting stud 86, and retaining plate 84 is removed by removing mounting bolts 96. Thereafter, cable 124 is disconnected at fitting 122, and the mounting bolts 80 are removed to release the sleeve and plunger components for removal as a unit by hand. Retaining plate 134 and plunger shoulder 140 advantageously maintain the sleeve and plunger components in assembled relationship, whereby the transducer components remain completely enclosed and protected against the surrounding environment. The transducer module, or a new modular unit can readily be installed by reversing the foregoing procedure, and the preassembled modular unit advantageously enables such installation to be achieved without subjecting the transducer components to possible damage during the installation procedure.

While considerable emphasis has been placed herein on the preferred embodiment disclosed and described, it will be appreciated that many embodiments of the invention can be made and many changes can be made in the preferred embodiment without departing from the principles of the present invention. In this respect, for example, other housing arrangements can be provided having expandable and contractable walls for enclosing and supporting the transducer components for displacement relative to one another, and other mounting arrangements can be devised for connecting the housing with the piston and cylinder members of the force applying assembly for the transducer components to be relatively displaceable therewith. Further, with a sleeve and plunger housing assembly as disclosed herein, the sleeve component could be connected to the piston of the hydraulic roll force applying assembly other than through the bolted flange arrangement shown. These as well as other modifications will be obvious and/or suggested to those skilled in the art from the foregoing description. Accordingly, it is to be distinctly understood that the foregoing descriptive matter is to be interpreted merely as illistrative of the present invention and not as a limitation.

I claim:

1. A modular transducer assembly for mounting between relatively reciprocable first and second members of a roll mill gap adjusting mechanism comprising, linearly extendable and retractable housing means having opposite ends in the direction of extension and retraction, transducer means including first and second transducer components supported in said housing means each with respect to one of said opposite ends for displacement relative to one another in said direction and in response to extension and retraction of said housing means, means mounting said housing means between said first and second roll mill members with said opposite ends exposed with respect thereto and for said housing means to extend and retract in response to relative reciprocation of said roll mill members, said first and second transducer components having a null position with respect to one another, and means at each of said opposite ends of said housing means for adjusting the corresponding one of said first and second transducer components relative to the other to obtain null positioning when said housing means is mounted between said roll mill members.

2. The transducer assembly according to claim 1, wherein said first transducer component is transformer coil means and said second transducer component is core rod means.

3. The transducer assembly according to claim 1, wherein said housing means includes first and second housing members having inner and outer ends, said outer ends defining said opposite ends of said housing means and said inner ends being interconnected for said first and second housing members to be relatively displaceable in the direction between said opposite ends.

4. The transducer assembly according to claim 3, wherein said mounting means includes mounting means for each said first and second housing members for connection respectively with said first and second roll mill members.

5. The transducer assembly according to claim 4, wherein said first and second transducer components are mounted in said housing means for displacement respectively with said first and second housing members.

6. The transducer assembly according to claim 5, wherein said first transducer component is a differential transformer coil and said second transducer component is a core rod.

7. A modular transducer assembly for mounting in aligned openings through relatively linearly displaceable first and second members of a roll mill roll gap adjusting mechanism comprising, housing means received in said openings and having opposite ends, said housing means including sleeve means and plunger means having slidably interengaged inner ends and corresponding outer ends, said inner end of said sleeve means and said outer end of said plunger means being at the same end of said housing means, transducer means including a first transducer component in said housing means mounted on said plunger means for displacement therewith and a second transducer component in said housing means mounted on said sleeve means for displacement therewith, means for connecting said outer end of said plunger means with one of said first and second roll mill members for displacement therewith, and means for connecting said inner end of said sleeve means with the other of said roll mill members for displacement therewith, whereby relative displacement between said roll mill members displaces said plunger means and sleeve means and the corresponding one of said first and second transducer components relative to one another.

8. The transducer assembly according to claim 7, wherein said first and second transducer components have a null position with respect to one another, and means at said outer ends of said plunger means and sleeve means for adjusting the corresponding one of said first and second transducer components relative to the other to obtain null positioning when said plunger means and sleeve means are connected with said roll mill members.

9. A modular transducer assembly for mounting in aligned openings through relatively linearly displaceable first and second members of a roll mill roll gap adjusting mechanism comprising, housing means received in said openings and including sleeve means and plunger means having slidably interengaged inner ends and corresponding outer ends, transducer means including a first transducer component in said housing means mounted on said plunger means for displacement therewith and a second transducer component in said housing means mounted on said sleeve means for displacement therewith, means for connecting said outer end of said plunger means with one of said first and second roll mill members for displacement therewith, means for connecting said inner end of said sleeve means with the other of said roll mill members for displacement therewith, whereby relative displacement between said roll mill members displaces said plunger means and sleeve means and the corresponding one of said first and second transducer components relative to one another, said means for connecting said plunger means with said one roll mill member including retainer plate means and adjusting stud means at said outer end of said plunger means, said plate means being connectable to said one roll mill member, said adjusting stud means being rotatably supported on said plate means and having an end interconnected with said outer end of said plunger means, and means interengaging said ends of said stud means and plunger means for rotation of said stud means to displace said plunger means relative to said plate means and axially of said sleeve means to adjust said first transducer component relative to said second transducer component.

10. A modular transducer assembly for mounting in aligned openings through relatively linearly displaceable first and second members of a roll mill roll gap adjusting mechanism comprising, housing means received in said openings and including sleeve means and plunger means having slidably interengaged inner ends and corresponding outer ends, transducer means including a first transducer component in said housing means mounted on said plunger means for displacement therewith and a second transducer component in said housing means mounted on said sleeve means for displacement therewith, means for connecting said outer end of said plunger means with one of said first and second roll mill members for displacement therewith, means for connecting said inner end of said sleeve means with the other of said roll mill members for displacement therewith, whereby relative displacement between said roll mill members displaces said plunger means and sleeve means and the corresponding one of said first and second transducer components relative to one another, said outer end of said sleeve means including end wall means, adjusting rod means rotatably supported by said end wall means and having an inner end in said sleeve means, and means interconnecting said inner end of said adjusting rod means with said second transducer component for rotation of said adjusting rod means to axially displace said second transducer component relative to said sleeve means and said first transducer component.

11. The transducer assembly according to claim 10, wherein said means for connecting said plunger means with said one roll mill member includes retainer plate means and adjusting stud means at said outer end of said plunger means, said plate means being connectable to said one roll mill member, said adjusting stud means being rotatably supported on said plate means and having an end interconnected with said outer end of said plunger means, and means interengaging said ends of said stud means and plunger means for rotation of said stud means to displace said plunger means relative to said plate means and axially of said sleeve means to adjust said first transducer component relative to said second transducer component.

12. The transducer assembly according to claim 7, wherein said first transducer component is differential transformer coil means mounted on said plunger means and having an opening therethrough coaxial with said cylinder means, and said second transducer means is a core rod coaxial with said sleeve means and extending into said transformer opening.

13. The transducer assembly according to claim 12, wherein said transformer coil means and core rod have a null position with respect to one another, and means to axially adjust the position of each said transformer coil means and core rod relative to the other to obtain null positioning when said plunger means and sleeve means are connected with said roll mill members.

14. A modular transducer assembly for mounting in aligned openings through relatively linearly displaceable first and second members of a roll mill roll gap adjusting mechanism comprising, housing means received in said openings and including sleeve means and plunger means having slidably interengaged inner ends and corresponding outer ends, transducer means including a first transducer component in said housing means mounted on said plunger means for displacement therewith and a second transducer component in said housing means mounted on said sleeve means for displacement therewith, means for connecting said outer end of said plunger means with one of said first and second roll mill members for displacement therewith, means for connecting said inner end of said sleeve means with the other of said roll mill members for displacement therewith, whereby relative displacement between said roll mill members displaces said plunger means and sleeve means and the corresponding one of said first and second transducer components relative to one another, said first transducer component being differential transformer coil means mounted on said plunger means and having an opening therethrough coaxial with said cylinder means, said second transducer means being a core rod coaxial with said sleeve means and extending ratio into said transformer opening, said transformer coil means and core rod have a null position with respect to one another, and means to axially adjust the position of each said transformer coil means and core rod relative to the other to obtain null positioning when said plunger means and sleeve means are connected with said roll mill members, said means for connecting said plunger means with said one roll mill member including a retaining plate connectable to said one roll mill member and an adjusting stud interconnecting said plate and said outer end of said plunger means, said stud being interconnected with said plate for rotation relative thereto and having an end threadedly interengaged with said outer end of said plunger means for rotation of said stud to axially displace said plunger means relative to said plate and said sleeve member to axially adjust said transformer coil means relative to said core rod.

15. A modular transducer assembly for mounting in aligned openings through relatively linearly displaceable first and second members of a roll mill roll gap adjusting mechanism comprising, housing means received in said openings and including sleeve means and plunger means having slidably interengaged inner ends and corresponding outer ends, transducer means including a first transducer component in said housing means mounted on said plunger means for displacement therewith and a second transducer component in said housing means mounted on said sleeve means for displacement therewith, means for connecting said outer end of said plunger means with one of said first and second roll mill members for displacement therewith, means for connecting said inner end of said sleeve means with the other of said roll mill members for displacement therewith, whereby relative displacement between said roll mill members displaces said plunger means and sleeve means and the corresponding one of said first and second transducer components relative to one another, said first transducer component being differential transformer coil means mounted on said plunger means and having an opening therethrough coaxial with said cylinder means, and said second transducer means being a core rod coaxial with said sleeve means and extending into said transformer opening, said transformer coil means and core rod have a null position with respect to one another, and means to axially adjust the position of each said transformer coil means and core rod relative to the other to obtain null positioning when said plunger means and sleeve means are connected with said roll mill members, said outer end of said sleeve means including an end wall, an adjusting rod extending through said end wall and having an inner end in said sleeve means, said core rod being mounted on said inner end of said adjusting rod, and said adjusting rod being threadedly interengaged with said end wall for rotation of said adjusting rod to axially displace said core rod relative to said sleeve means and said transformer coil means.

16. The transducer according to claim 15, wherein said means for connecting said plunger means with said one roll mill member includes a retaining plate connectable to said one roll mill member and an adjusting stud interconnecting said plate and said outer end of said plunger means, said stud being interconnected with said plate for rotation relative thereto and having an end threadedly interengaged with said outer end of said plunger means for rotation of said stud to axially displace said plunger means relative to said plate and said sleeve means to axially adjust said transformer coil means relative to said core rod.

17. The transducer according to claim 16, wherein said means for connecting said inner end of said sleeve means with said other roll mill member is flange means on said inner end of said sleeve means.

18. The transducer according to claim 17, wherein said flange means and retainer plate are parallel and said retainer plate is removably interconnected with said adjusting stud for separation therefrom.

19. A modular transducer assembly for mounting in aligned openings through relative linearly displaceable first and second members of a roll mill roll gap adjusting mechanism comprising, housing means received in said openings and including sleeve means and plunger means having slidably interengaged inner ends and corresponding outer ends, transducer means including a first transducer component in said housing means mounted on said plunger means for displacement therewith and a second transducer component in said housing means mounted on said sleeve means for displacement therewith, means for connecting said outer end of said plunger means with one of said first and second roll mill members for displacement therewith, means for connecting said inner end of said sleeve means with the other of said roll mill members for displacement therewith, whereby relative displacement between said roll mill members displaces said plunger means and sleeve means and the corresponding one of said first and second transducer components relative to one another, said means for connecting said plunger means with said one roll mill member including plate means and means removably mounting said plate means on said outer end of said plunger means, said plate means extending transverse to the axis of said plunger means, and said means for connecting said inner end of said sleeve means with said other roll mill member being radially outwardly extending flange means on said inner end of said sleeve means.

20. The transducer assembly according to claim 19, wherein said first transducer component is differential transformer coil means mounted on said plunger means and having an opening therethrough coaxial with said sleeve means, and said second transducer means is a core rod coaxial with said sleeve means and extending into said transformer opening.

21. The transducer assembly according to claim 20, further including spring means in said sleeve means biasing said plunger means in the direction toward said inner end of said sleeve means, and means interengaging said plunger means and sleeve means to limit movement of said plunger means in said direction.

22. The transducer assembly according to claim 21, wherein said means removably mounting said plate means on said outer end of said plunger means includes means for axially displacing said plunger means relative to said sleeve means when said plunger means and sleeve means are connected with said roll mill members to axially adjust the position of said transformer coil means relative to said core rod, and means on said outer end of said sleeve means for axially adjusting the position of said core rod with respect to said sleeve means.

23. The transducer assembly according to claim 22, wherein said means for axially displacing said plunger means relative to said sleeve means includes an adjusting stud rotatable relative to said plate means and interengaged with said outer end of said plunger means for rotation of said stud to axially displace said plunger means relative to said sleeve means.

* * * * *